US006231082B1

(12) United States Patent
Van Boom et al.

(10) Patent No.: US 6,231,082 B1
(45) Date of Patent: May 15, 2001

(54) TAMPER-EVIDENT FORM FOR SECURELY CARRYING INFORMATION

(75) Inventors: Joel Bryan Van Boom, Santa Ana, CA (US); Chuck Casagrande, Newbury (GB); Bernard Willem Scheggetman, Fyshwick (AU)

(73) Assignee: Documotion Research, Inc., Wilmington, DE (US)

( * ) Notice: Subject to any disclaimer, the term of this patent is extended or adjusted under 35 U.S.C. 154(b) by 0 days.

(21) Appl. No.: 09/505,221

(22) Filed: Feb. 16, 2000

Related U.S. Application Data

(62) Division of application No. 09/183,116, filed on Oct. 30, 1998.

(30) Foreign Application Priority Data

Nov. 7, 1997 (AU) ..... PP0273

(51) Int. Cl.[7] ..... B42D 15/00

(52) U.S. Cl. ..... 283/100; 283/72; 283/94; 283/99; 283/111; 283/103; 283/107; 283/81

(58) Field of Search ..... 283/72, 94, 99, 283/100, 111, 114, 103, 107, 26, 27, 23, 81

(56) References Cited

U.S. PATENT DOCUMENTS

| | | | | |
|---|---|---|---|---|
| 1,996,288 | * | 4/1935 | Galt . | |
| 2,952,080 | * | 9/1960 | Avakian et al. . | |
| 3,001,886 | * | 9/1961 | Schrewsbuty | 283/901 |
| 3,279,826 | * | 10/1966 | Rudershausen et al. . | |
| 3,315,386 | * | 4/1967 | Kest et al. . | |
| 3,520,757 | * | 7/1970 | Heaney et al. . | |
| 3,675,948 | * | 7/1972 | Wicker | 283/6 |
| 4,109,047 | * | 8/1978 | Fredrickson | 428/307 |
| 4,174,857 | * | 11/1979 | Koza | 283/6 |
| 4,299,637 | * | 11/1981 | Oberdeck et al. | 283/6 |
| 4,379,573 | * | 4/1983 | Lomeli et al. | 283/81 |
| 4,551,373 | * | 11/1985 | Conlon | 283/106 |
| 4,668,597 | * | 5/1987 | Merchant | 283/902 |
| 4,778,153 | * | 10/1988 | Bachman et al. | 283/101 |
| 4,790,565 | * | 12/1988 | Steed | 283/81 |
| 4,889,365 | * | 12/1989 | Chouiard | 283/70 |
| 5,238,272 | * | 8/1993 | Taylor | 283/79 |
| 5,253,899 | * | 10/1993 | Greenwood | 283/106 |

(List continued on next page.)

FOREIGN PATENT DOCUMENTS

| | | |
|---|---|---|
| 0 271 673 | 6/1988 | (EP) . |
| 1259277 | 3/1961 | (FR) . |
| 851749 | 10/1960 | (GB) . |
| 894081 | 4/1962 | (GB) . |
| 12356941 | 6/1971 | (GB) . |
| 1590274 | 5/1981 | (GB) . |
| WO 91/18376 | 11/1991 | (WO) . |

*Primary Examiner*—A. L. Wellington
*Assistant Examiner*—Alisa L Thurston
(74) *Attorney, Agent, or Firm*—St. Onge Steward Johnston & Reens LLC

(57) ABSTRACT

A tamper-evident form for securely carrying information includes a scrambling pattern (4) which underlies the printed information such that the printed information cannot be read. Separation of the printed information and scrambling pattern, or other disabling of the scrambling pattern, is tamper-evident and renders the information readable. In preferred embodiments the information is printed on a lamina (6) which overlies the scrambling pattern (4). The information can be printed by conventional printers and no post-processing of the form is required to render the information secure.

10 Claims, 5 Drawing Sheets

U.S. PATENT DOCUMENTS 5,286,061 * 2/1994 Behm ..... 283/95
5,288,977 * 2/1994 Amendolia et al. ..... 235/375
5,346,258 * 9/1994 Behm et al. ..... 283/102
5,618,112 * 4/1997 Lovell ..... 283/103
5,839,763 * 11/1998 McCannel ..... 283/109
5,863,075 * 1/1999 Rich et al. ..... 283/94
5,893,587 * 4/1999 Wong ..... 283/98
6,022,051 * 2/2000 Casgrande ..... 283/107
6,113,150 * 9/2000 Kinberg ..... 283/94
6,114,077 * 9/2000 Voets et al. ..... 430/110

* cited by examiner

TAMPER-EVIDENT FORM FOR SECURELY CARRYING INFORMATION

This is a divisional application of U.S. Ser. No. 09/183,116 filed Oct. 30, 1998.

TECHNICAL FIELD

This invention relates to a tamper-evident form for securely carrying information.

BACKGROUND ART

There is often the need to transmit confidential information through the mail or other channels such as courier, document exchange, hand delivery etc. For example, banks and other financial institutions often mail out Personal Identification Numbers (PINs) associated with customer's credit or debit cards.

Forms are known which carry such information in a secure manner, ie. the information cannot be viewed without first breaching some form of security associated with the form. An example of such a form is a lottery ticket known as a "scratchy" in which a coating must be scratched away to reveal the underlying information.

Necessarily, these forms for securely carrying information are tamper-evident, ie. the act of breaching the security of the information causes some irreversible indication that a breach of security has occurred.

Most tamper-evident forms are constructed such that further processing of the form, such as coating (eg. "scratchy") or folding and sealing, is required to secure the information after the information has been printed on the form. This is a significant inconvenience and often requires special equipment which is prohibitive to many users.

One known tamper-evident form which does not require further processing after the confidential information has been received involves a two-ply arrangement which is sealed together around its perimeter. With this form, an impact printer strikes the upper surface of the upper ply thereby leaving a "carbon" imprint on the upper surface of the lower ply. To access the information on the lower ply, the two plies must be peeled or torn apart.

Preferred embodiments of the present invention provide a tamper-evident form for securely carrying information in which the information can be printed on the form by passing the form through a conventional printer and in which the printed form does not require further processing to render the information secure.

DISCLOSURE OF INVENTION

The invention broadly resides in the selective use of scrambling means to render printed information unreadable. The negation or disablement of the scrambling means renders the printed information readable, however, the negation or disablement of the scrambling means is tamper-evident thereby indicating that the security of the information has been compromised.

This invention in one aspect resides in a tamper-evident form for securely carrying information, the form including scrambling means adapted to have the information superimposed thereover or thereon such that the overlying information cannot be ascertained until the overlying information and underlying scrambling means are separated, or until the underlying scrambling means is otherwise negated or disabled.

In one embodiment, a transparent or translucent release layer is superimposed on the scrambling means and the information is printed directly onto the release layer. The information can then be removed from the release layer by, for example, placing an adhesive tape over the print on the release layer and then removing the printed information from the release layer with the tape.

In another more preferred embodiment, the information is printed on a transparent or translucent lamina which overlies the scrambling means.

The scrambling means may be printed on a substrate or the scrambling means may be a coating or masking which can be scratched or peeled away from beneath the lamina.

Desirably, any separation of the printed lamina and the underlying scrambling means causes an irreversible indication that the security of the information on the lamina has been breached.

The printed lamina can be removed from the underlying scrambling means or, alternatively, the underlying scrambling means can be removed from the printed lamina.

In one embodiment, a portion of the lamina is die cut from the remainder of the lamina. The die cut may be incomplete and the portion of the lamina may remain attached to the remainder of the lamina by ties which must be broken to remove the portion of the lamina. In this case the broken ties provide an indication that the security of the information has been breached. The die cut may also be of a saw-tooth or other profile to prevent easy replacement of the portion of the lamina and to provide a further visual indication that the security of the information has been breached. Any form of known tamper indication may be used.

In another embodiment, the substrate is die cut and the portion of the substrate underlying the information may be removed. Again, removal of the portion of the substrate is tamper-evident by virtue of broken ties or other known tamper indication means.

In other embodiments the underlying scrambling means can be negated or disabled via, for example, the application of heat, pressure or light. For example, the scrambling means may be constituted by an ink which irreversibly clarifies at, say, 75 degrees Celcius. With such an arrangement, the end user might apply a warm clothes iron to disable the scrambling means thereby revealing the printed information.

In another aspect this invention resides in a tamper-evident form for securely carrying information, the form including a transparent or translucent lamina overlying scrambling means such that information printed on the transparent or translucent lamina cannot be ascertained until the printed lamina and underlying scrambling means are separated, or until the the underlying scrambling means is otherwise negated or disabled.

In another aspect the invention resides in a method of rendering printed information secure, the method including:

printing the information over scrambling means such that the printed information cannot be ascertained until the information and the underlying scrambling means are separated, or the underlying scrambling means is otherwise negated or disabled.

In preferred embodiments the information is printed on a transparent or translucent lamina.

In another aspect the invention resides in a method of producing a tamper-evident form for securely carrying information, the method including:

providing scrambling means adapted to have the information superimposed thereover or thereon such that the overlying information cannot be ascertained until the overlying information and underlying scrambling means are separated, or until the underlying scrambling means is otherwise negated or disabled.

BRIEF DESCRIPTION OF DRAWINGS

In order that this invention may be more easily understood and put into practical effect, reference will now be made to the accompanying drawings which illustrate preferred embodiments of the invention, wherein.

BEST MODE

Figure 3:
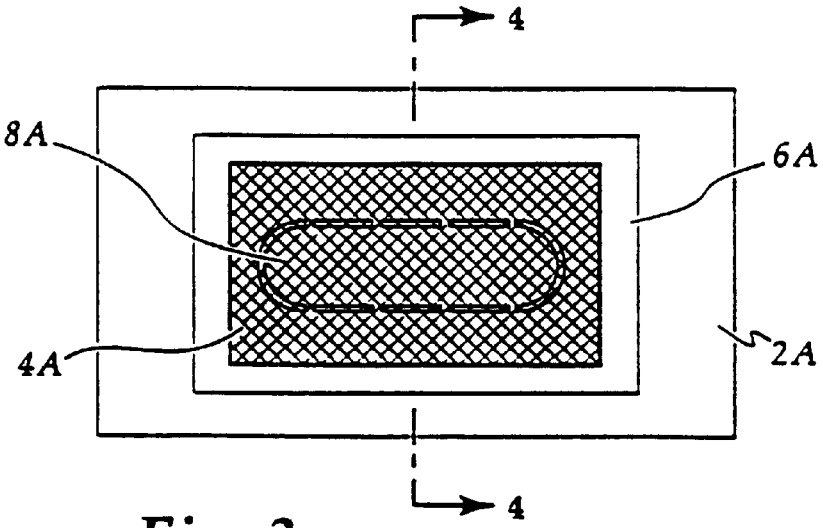
FIG. 3 is a plan view of the die-cut lamina of FIG. 2 adhered to the substrate of FIG. 1 according to a first embodiment.
Figure 4:
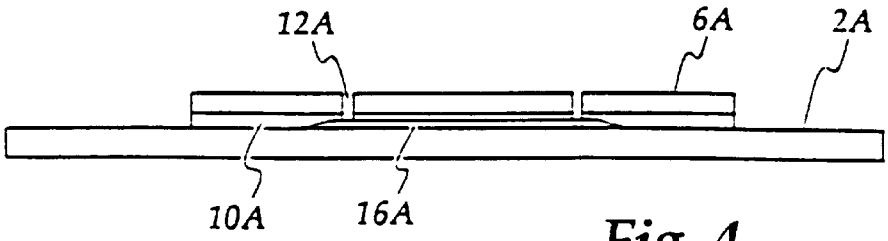
FIGS. 4 and 5 are sequential sectional views along line 4—4 of FIG. 3.
Figure 5:
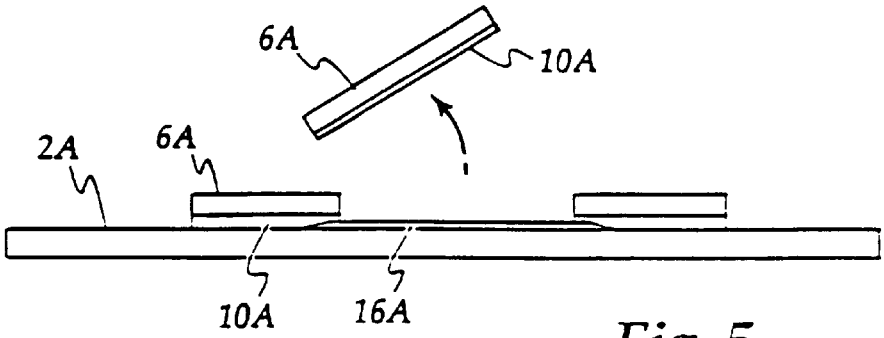

With reference firstly to FIGS. 3 to 5 there is illustrated a first embodiment of a tamper-evident form according to the invention.

Figure 1:
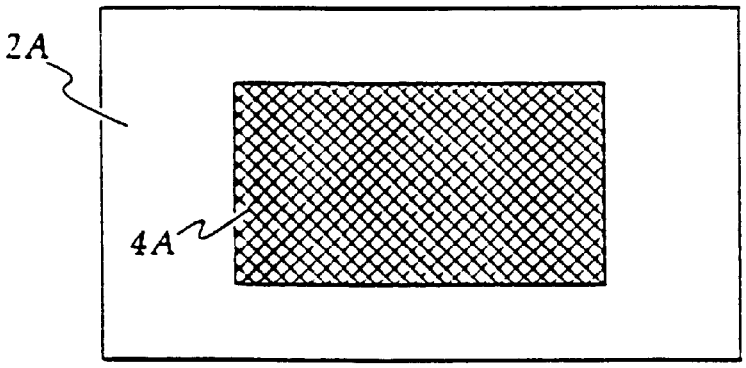
FIG. 1 is a plan view of a substrate having scrambling means printed thereon.
Figure 2:
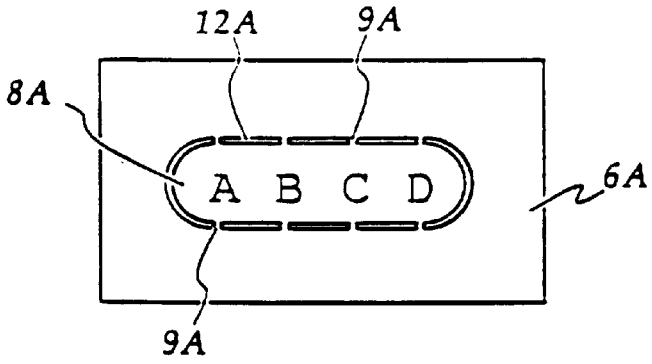
FIG. 2 is a plan view of a transparent or translucent die-cut lamina.

The tamper-evident form is comprised of two major components, being a substrate 2A (illustrated in isolation in FIG. 1) and a die-cut lamina 6A (illustrated in isolation in FIG. 2).

Referring to FIG. 1, substrate 2A is a sheet of paper or the like having printed thereon scrambling means 4A which, in this case, is rectangular in shape.

The scrambling means 4A may be of any type, but it is preferred that the scrambling means is created by a non-saturated mass of overprinted alpha-numeric characters as is known in the art. It will be understood that the cross-hatched area 4A is representative of the scrambling means. In other embodiments, the scrambling means may be comprised of other types of characters, random markings, or simply a darkly shaded area.

Referring to FIG. 2, lamina 6A is transparent or translucent and includes an incomplete or perforate die cut 12A defining within the die cut a removable portion of the lamina. The incomplete die cut 12A leaves ties 9A whereby the removable portion of the lamina (in this case having the confidential information "ABCD" printed thereon) remains connected to the remainder of the lamina. The ties 9A are frangible such that the portion of the lamina having the information "ABCD" may be removed from the remainder of the lamina and such removal is tamper-evident by virtue of the broken ties. Removal of the portion of the lamina is facilitated by the provision of tabs 8A which can be manually lifted and grasped.

Referring now to FIG. 3, there is illustrated a first embodiment of the invention in which the lamina 6A of FIG. 2 has been adhered about its perimeter to substrate 2A of FIG. 1. It will be understood that any information printed on the transparent or translucent lamina 6A cannot be ascertained due to the fact that the information is superimposed on the scrambling means 4A.

Normally, the confidential information printed on the lamina 6A will be alpha-numeric characters and hence these alpha-numeric characters are "lost" in the background scrambling means which is a mass of overprinted alpha-numeric characters. The confidential information can only be "found" when the portion of the lamina is separated from the substrate. In order to assist the "losing" of the confidential information, the confidential information is relatively lightly printed on the lamina.

Referring now to FIGS. 4 and 5, there are illustrated sequential sectional views of the first embodiment of the invention. It will be appreciated that the thickness of the form is greatly exaggerated. In fact, the form is thin enough to pass through a conventional laser printer.

As can be seen, transparent or translucent lamina 6A is adhered to substrate 2A by virtue of adhesive layer 10A.

A release layer 16A (eg. silicon) is provided intermediate adhesive layer 10A and substrate 2A so that the removable portion of the lamina 6A may be easily removed as shown in FIG. 5 carrying with it a portion of adhesive layer 10A. The removed portion of the lamina 6A can then be re-adhered via the removed portion of adhesive layer 10A to any surface, including the substrate 2A.

It will be recalled that removal of the portion of the lamina 6A as shown in FIG. 5 involves a breakage of the frangible ties 9A. Hence, removal of the portion of the lamina 6A is tamper-evident.

In use, the invention is provided to the user (such as a bank or other financial institution) in the format shown in FIG. 4.

The bank can then pass the entire form, consisting of the combined substrate 2A and lamina 6A, through a laser printer which prints the confidential information (eg. PIN, or in this case "ABCD") on the upper surface of the transparent or translucent lamina 6A. It will be understood that, whilst the confidential information "ABCD" has been printed on the upper surface of the lamina 6A, it cannot be ascertained due to the underlying scrambling means 4A.

The bank customer's address details can also be simultaneously laser printed onto the substrate 2A in the normal manner and the form can be placed into a windowed envelope for immediate mailing to the customer.

Of course, the form will also include instructions to the bank's customer explaining how to "find" the confidential information "ABCD" by removing the portion of the lamina 6A.

It will be appreciated that the confidential information is "found" by tearing the removable portion of the lamina 6A away from the substrate 2A as shown in FIG. 5. Once the removable portion of the lamina 6A has been removed, the confidential information is readily visible, particularly so if the removed portion is re-adhered to a light background, eg. the form.

In the event that the frangible ties 9A are already broken when the form is received, the customer will immediately know that the security of the confidential information "ABCD" has been compromised and will know to advise the bank to re-issue a new PIN.

Figure 6:
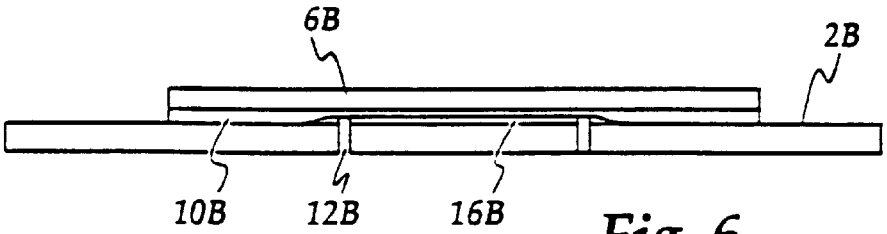
FIGS. 6 and 7 are sequential sectional views of a second embodiment.
Figure 7:
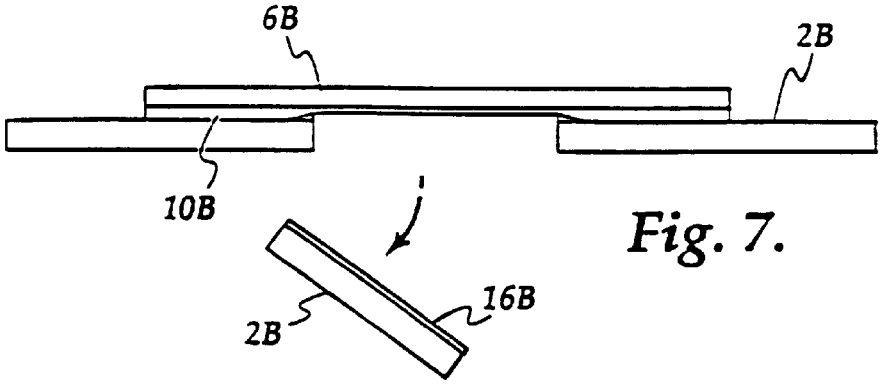

Referring now to FIGS. 6 and 7 there is illustrated a second embodiment of the invention in which the same reference numerals have been used to denote the same features.

Again, the form is comprised of a substrate 2B and a transparent or translucent lamina 6B adhered together by a layer of adhesive 10B. However, in this case the die cut 12B is provided in the substrate 2B rather than in the lamina 6B and the die cut extends through release layer 16B. Accordingly, a portion of the substrate 2B is removable from the form as shown in FIG. 7, rather than the lamina being removable from the form as was the case with the first embodiment.

It will be noted that a layer of adhesive 10B is provided to bond the lamina 6B to the substrate 2B. A release layer 16B is also provided to enable the portion of the substrate to be removed as shown in FIG. 7. The die cut 12B extends through release layer 16B and therefore the release layer is removed with the portion of the substrate as shown in FIG. 7.

As previously, the die cut 12B is incomplete or perforated so that removal of the portion of the substrate is tamper-evident.

If desired, the removed portion of the substrate 2B can be rotated through 180 degrees so that the substrate 2B is above the release layer 16B. The removed portion of substrate 2B can then be replaced in the cavity created by its own removal. It will be understood that the removed portion 2B readily adheres to adhesive layer 10B.

In use, the form is provided to the bank as shown in FIG. 6. The bank can pass the form through a laser printer which prints address details on the substrate 2B in the normal manner and prints confidential information on the upper surface of the lamina 6B. Again, it will be appreciated that the confidential information cannot be ascertained at this time due to the underlying scrambling means which is printed on the substrate.

When the bank's customer receives the form through the mail or other channels, he or she can readily determine whether the security of the information has been compromised and can readily access the information by tearing away the portion of the substrate 2B which underlies the confidential information as shown in FIG. 7. Once the portion of the substrate 2B has been removed, the confidential information is visible as the underlying scrambling means has been removed. Visability is enhanced if the removed portion of substrate is turned over and returned to the cavity created by its own removal.

Figure 6A:
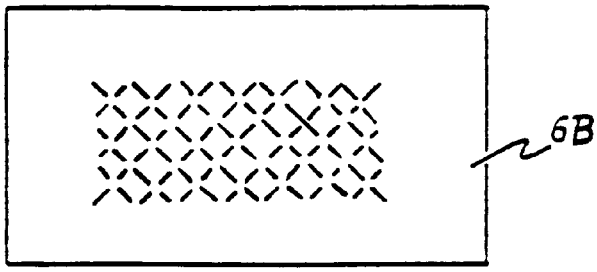
FIG. 6A is a plan view of the transparent or translucent slitted lamina of the second embodiment illustrated in FIGS. 6 and 7.

Referring to FIG. 6A, the lamina 6B of the second embodiment illustrated in FIGS. 6 and 7 includes an additional security/tamper-evident feature.

It has been found that it is sometimes possible to remove the confidential information (ie. the laser toner) from the lamina via the use of an adhesive strip. The adhesive strip can be applied to the top surface of the lamina 6B, and when the adhesive strip is removed, the laser toner is separated from the lamina and carried (in reverse, of course) on the underside of the adhesive strip.

As shown in FIG. 6A, the lamina can be slit (for example in a cross-hatched pattern to define a plurality of diamonds) such that the structural integrity of the lamina is reduced to a level that the lamina tears apart if an attempt is made to remove the toner with an adhesive strip as described above. Thus, in the embodiment illustrated in FIG. 6A, one or more of the diamonds is torn away with the adhesive strip thereby achieving a tamper-evident function.

It has also been surprisingly discovered that, if the lamina does not rupture as intended, the toner has a adhesive strip. It is believed that this is due to the disruption to the surface of the lamina which is caused by the slitting or scoring.

Figure 8:
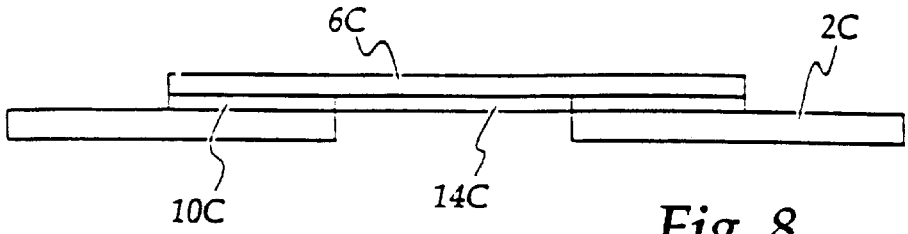
FIGS. 8 and 9 are sequential sectional views of a third embodiment.
Figure 9:
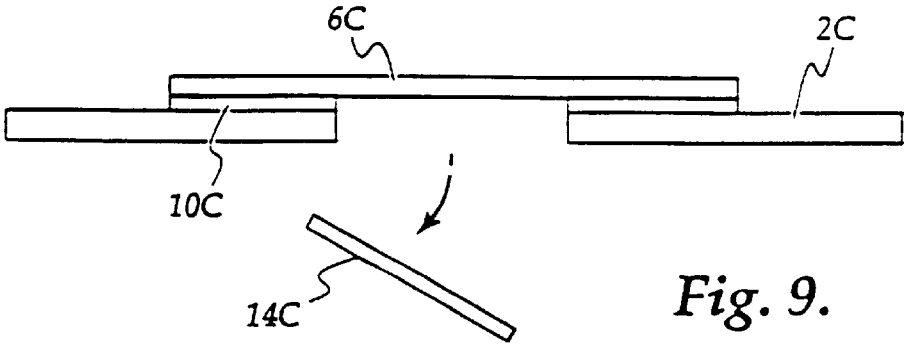

Referring now to FIGS. 8 and 9, there is illustrated sequential sectional views of a third embodiment of the invention in which the same reference numerals have been used to denote the same features.

Again, there is a substrate 2C and a transparent or translucent lamina 6C. In this case, the substrate 2C has an aperture or hole provided beneath lamina 6C.

The lamina is adhered to the substrate by virtue of adhesive 10, which in this case is provided around the perimeter of the underside of the lamina 6C. Within the "ring" of adhesive 10C is provided a removable coating or masking 14C. In another embodiment, the adhesive layer 10C is continuous and the coating or masking is applied to the underside of the continuous adhesive layer.

The masking 14C may consist of one or more layers and carries the scrambling means such that information printed on the upper surface of lamina 6C cannot be ascertained. However, masking 14C may be scratched or peeled away to render the information visible. The masking 14C is shown being peeled away in FIG. 9.

In use, this embodiment is supplied as shown in FIG. 8. The bank passes the form through a laser printer thereby printing confidential information on the lamina 6C and printing address details and the like on substrate 2C.

When the form is received by the bank's customer, the masking or coating 14C is scratched or peeled away to render the confidential information visible. Again, this is a tamper-evident process.

Figure 10:
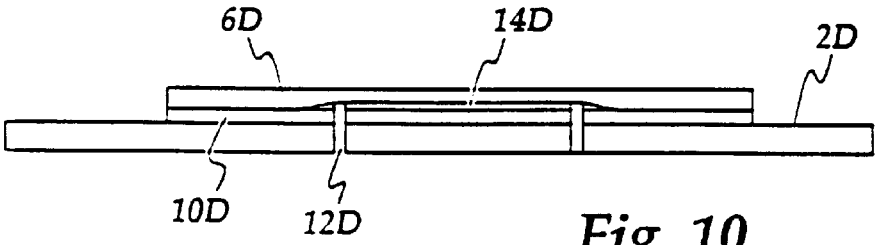
FIGS. 10 and 11 are sequential sectional views of a fourth embodiment.
Figure 11:
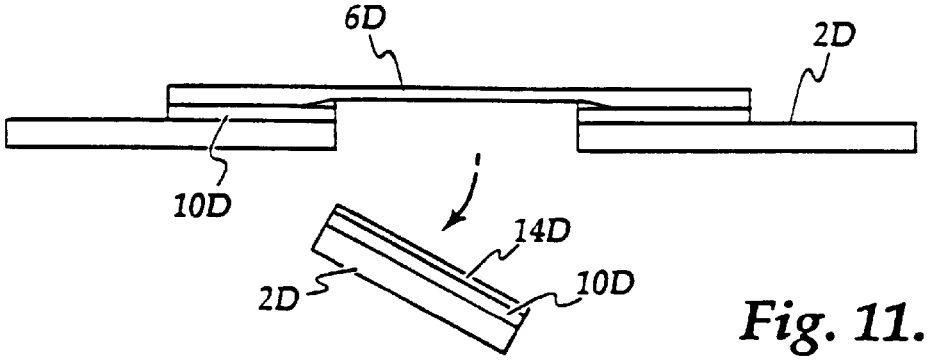

Referring now to FIGS. 10 and 11 there is shown sequential sectional views of a fourth embodiment of the invention which is a hybrid of the second and third embodiments.

The form is comprised of substrate 2D, adhesive layer 10D, masking or coating 14D and lamina 6D. In this case, the die cut 12D extends through the substrate, adhesive and coating, although this embodiment could be die-cut from the upper side with the die cut extending through the lamina 6D such that the lamina is removable.

This embodiment uses a coating 14D (which again may be one or more layers) is a breakaway coating which pulls away from the lamina 6D due to its greater affinity to the adhesive layer 10D. The scrambling means may be applied either on the substrate (in which case coating 14D would need to be transparent) or directly on the breakaway coating. The scrambling means could also be printed on the substrate side of the adhesive if the coating 14D is transparent.

Figure 12:
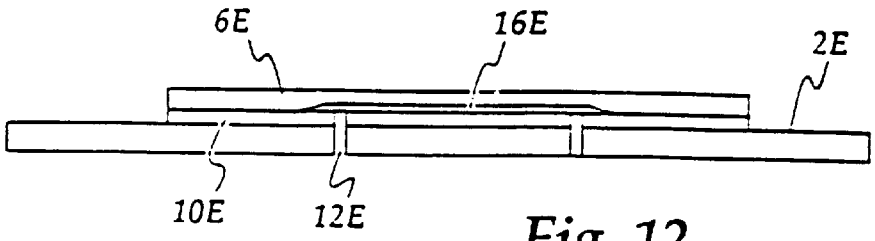
FIGS. 12 and 13 are sequential sectional views of a fifth embodiment.
Figure 13:
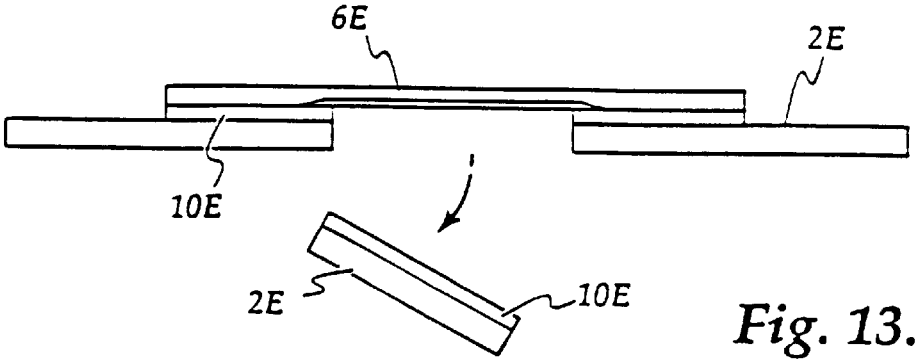

Referring now to FIGS. 12 and 13 there is illustrated sequential sectional views of a fifth embodiment which is similar to the second embodiment except the adhesive layer 10E and release layer 16E have been reversed.

This embodiment consists of a substrate 2E, adhesive layer 10E, release layer 16E and lamina 6E. As shown, the die cut extends from the underside through the substrate and adhesive, although the die cut could extend from the upper-side through the lamina and release layer.

This embodiment may use a two liner transfer tape and could have the scrambling means either printed on the substrate or on the underside of the release layer with the print being removed from the release layer by the adhesive.

Figure 14:
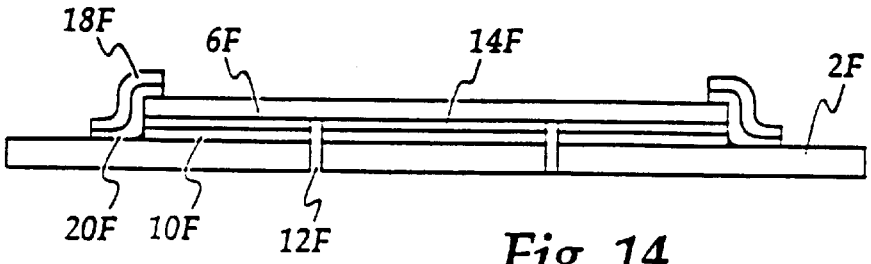
FIGS. 14 and 15 are sequential sectional views of a sixth embodiment.
Figure 15:
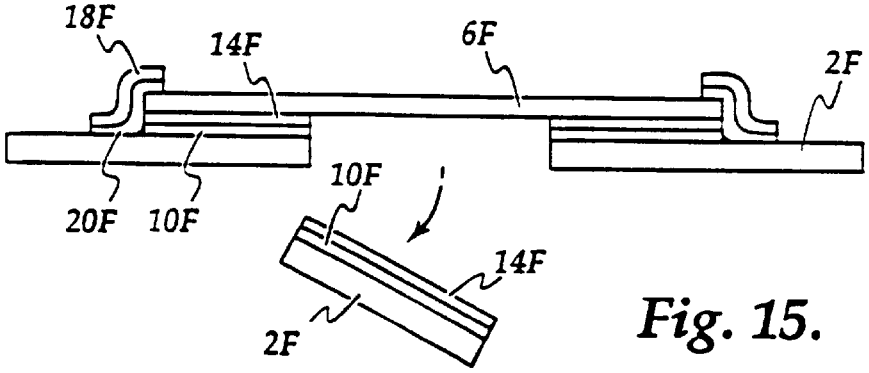

Referring now to FIGS. 14 and 15 there is illustrated sequential sectional views of a sixth embodiment. This embodiment is similar to the fourth embodiment, however it additionally includes a "frame" 18F which is adhered to the perimeter of lamina 6F and to substrate 2F by virtue of adhesive 2F. This "frame" ensures that the edge of lamina 6F cannot be lifted thereby ensuring that lamina 6F cannot be removed, viewed, and then replaced.

Figure 16:
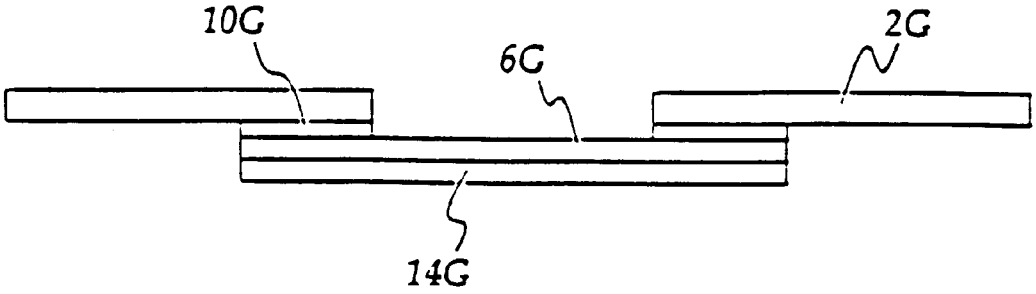
FIGS. 16 and 17 are sequential sectional views of a seventh embodiment.
Figure 17:
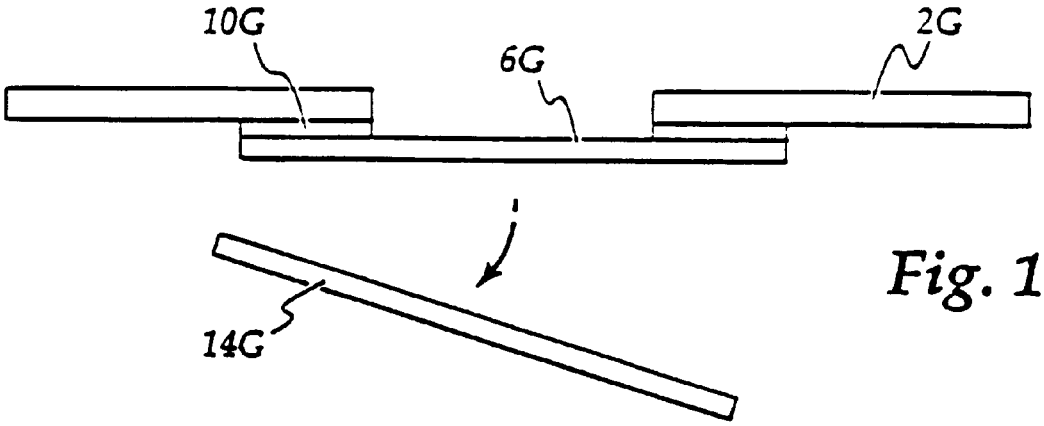

Referring now to FIGS. 16 and 17 there is illustrated sequential sectional views of a seventh embodiment. This embodiment is similar to the third embodiment except the lamina 6G and masking or coating 14G is adhered beneath the substrate 2G. Masking or coating 14G can be scratched away or peeled away as shown in FIG. 17.

Whilst several embodiments have been illustrated, it will be appreciated that numerous other embodiments, including hybrids of the illustrated embodiments, fall within the broad scope of the present invention.

In some embodiments, the underlying scrambling means or pattern may be negated or disabled to reveal the overlying information. This can be achieved, for example, by utilising a scrambling ink which can be clarified upon application of heat, light or pressure. In one embodiment, the scrambling pattern can be constituted by an ink which clarifies at about 75 degrees Celcius. In this embodiment, the end user might utilise a warm iron to disable the scrambling pattern and reveal the information.

The preferred embodiments of the present invention provide a tamper-evident form which requires no post-processing after the confidential information has been printed on the form to render the information secure. Furthermore, the confidential information can be printed by conventional printers such as lasers printers. Accordingly, the invention provides a tamper-evident secure form which is compatible with standard printing technology and does not require post-processing after printing.

It will of course be realised that whilst the above has been given by way of an illustrative example of this invention, all such and other modifications and variations hereto, as would be apparent to persons skilled in the art, are deemed to fall within the broad scope and ambit of this invention as is herein set fourth.

What is claimed is:

1. A method of rendering printed information secure, said method comprising the steps of:

bonding together an upper transparent lamina having an exposed upper surface and a lower non-transparent lamina bearing scrambling means which are visible from above through the upper transparent lamina, the scrambling means being selected such that information printed on the exposed upper surface of the upper transparent lamina cannot be read while the scrambling means is beneath the printed information;

printing information on the exposed upper surface of the upper transparent lamina; and wherein the printed information becomes readable when the bond between the upper transparent lamina and lower non-transparent lamina is broken and the upper transparent lamina and lower non-transparent lamina are physically separated.

2. The method of claim 1 wherein physical separation of the upper transparent lamina and lower non-transparent lamina causes an indication that the security of information printed on the exposed upper surface of the upper transparent lamina has been breached.

3. The method of claim 1 further comprising the step of scoring or slitting the upper transparent lamina such that an attempt to remove the printed information from the upper surface of the upper transparent lamina causes the upper transparent lamina to tear or rupture.

4. The method of claim 1 further comprising the step of die-cutting a portion of the lower non-transparent lamina such that the die-cut portion of the lower non-transparent lamina can be removed, thereby breaking the bond between the upper transparent lamina and lower non-transparent lamina so that the printed information becomes readable.

5. The method of claim 1 further comprising the step of die-cutting a portion of the upper transparent lamina such that the die-cut portion of the upper transparent lamina can be removed, thereby breaking the bond between the upper transparent lamina and lower non-transparent lamina so that the printed information becomes readable.

6. A method of rendering printed information secure, said method comprising the steps of:

bonding together an upper transparent lamina having an exposed upper surface and a lower non-transparent lamina bearing a scrambling pattern which is visible from above through the upper transparent lamina, the scrambling pattern being selected such that information printed on the exposed upper surface of the upper transparent lamina cannot be read whilst the scrambling pattern is beneath the printed information;

printing information on the exposed upper surface of the upper transparent lamina; and wherein the printed information becomes readable when the bond between the upper transparent lamina and lower non-transparent lamina is broken and the upper transparent lamina and lower non-transparent lamina are physically separated.

7. The method of claim 6 wherein physical separation of the upper transparent lamina and lower non-transparent lamina causes an indication that the security of information printed on the exposed upper surface of the upper transparent lamina has been breached.

8. The method of claim 6 further comprising the step of scoring or slitting the upper transparent lamina such that an attempt to remove the printed information from the upper surface of the upper transparent lamina causes the upper transparent lamina to tear or rupture.

9. The method of claim 6 further comprising the step of die-cutting a portion of the lower non-transparent lamina such that the die-cut portion of the lower non-transparent lamina can be removed, thereby breaking the bond between the upper transparent lamina and lower non-transparent lamina so that the printed information becomes readable.

10. The method of claim 6 further comprising the step of die-cutting a portion of the upper transparent lamina such that the die-cut portion of the upper transparent lamina can be removed, thereby breaking the bond between the upper transparent lamina and lower non-transparent lamina so that the printed information becomes readable.

* * * * *